US006986319B2

(12) United States Patent
Norrie

(10) Patent No.: US 6,986,319 B2
(45) Date of Patent: Jan. 17, 2006

(54) TETHERED SECTIONAL PIER SYSTEM

(76) Inventor: Kim L. Norrie, 3805 Andrew Jackson Dr., Pace, FL (US) 32571

( * ) Notice: Subject to any disclaimer, the term of this patent is extended or adjusted under 35 U.S.C. 154(b) by 0 days.

(21) Appl. No.: 10/930,393

(22) Filed: Aug. 31, 2004

(65) Prior Publication Data

US 2005/0056199 A1 Mar. 17, 2005

Related U.S. Application Data

(60) Provisional application No. 60/503,436, filed on Sep. 17, 2003.

(51) Int. Cl.
*B63B 35/44* (2006.01)
*E01D 19/02* (2006.01)

(52) U.S. Cl. ..... 114/263; 14/75; 405/219

(58) Field of Classification Search ..... 114/230.1, 114/258, 263, 264, 382, 44–48, 230.16, 230.27; 405/218–221; 14/75, 76, 77.3
See application file for complete search history.

(56) References Cited

U.S. PATENT DOCUMENTS 112,525 A * 3/1871 Albertson ..... 405/3
1,900,319 A * 3/1933 Vermeulen ..... 405/218
2,813,310 A * 11/1957 Harrison ..... 52/223.7
3,222,874 A * 12/1965 Zink ..... 405/221
3,465,528 A * 9/1969 Usab ..... 405/27
4,373,837 A * 2/1983 Lin et al. ..... 405/218
4,602,587 A * 7/1986 Lyons ..... 114/264
4,740,108 A * 4/1988 Levee et al. ..... 405/221
5,184,562 A * 2/1993 Hallin ..... 114/219
5,282,435 A * 2/1994 Chapman ..... 114/263
6,128,880 A 10/2000 Meenan, Jr.
6,663,322 B1 12/2003 Listle

* cited by examiner

*Primary Examiner*—Andrew D. Wright
(74) *Attorney, Agent, or Firm*—Robert C. Brown

(57) ABSTRACT

A pier system having tethered deck sections that are selectively separable from supporting pile bents to prevent damage to the pier system during storm events. The pier system includes a plurality of deck sections supported above water by pile bents and engaged therewith in normal use mode by selective attachment mechanisms. In deployment mode, the attachment mechanisms are disengaged to allow the deck sections to be removed from the pile support systems by storm action. The tethers allow the decking sections to float free but remain close to the pile bents. The system may be reassembled into normal use mode following the storm event.

4 Claims, 12 Drawing Sheets

TETHERED SECTIONAL PIER SYSTEM

The present invention draws priority from a U.S. Provisional Patent Application Ser. No. 60/503,436, filed Sep. 17, 2003.

BACKGROUND OF INVENTION

1. Field of Invention

The present invention relates in general to marine pier systems which are resistant to damage caused by wave, wind or tidal action during violent storm events, and in particular to pier systems which may be partially disassembled during violent storm events to prevent damage thereto and may be reassembled after the storm event.

2. Description of the Prior Art

One of the most common problems with piers used for marine pleasure craft and marine recreation is damage related to violent storms. A number of different storm-related damage problems can occur, including crushing and buckling of piers due to wind and wave action, that is, as high waves and wind continue to act against the pier the pier can be forced to move horizontally and vertically. As wave heights increase, the wave action can exert an upward force on the pier and result in the decking sections being separated from the support piles and/or deck planks separated from the decking. Such wave force can even exert enough upward force to cause the piles to be pulled free of the bottom. Floating debris can cause damage and destruction of property when wave and wind action drive floating debris into the pier. Also, as damage and destruction to the pier occurs, various pieces of the pier such as lumber, piles, decking section, etc. become separated from the pier. The pieces of debris then become hazards to humans and property as wind and waves continue to propel this debris throughout the vicinity.

A number of remedies are known in the art to avoid or at least minimize such storm-related damage. These include at least (1) heavy reinforcement of a pier to the extent that a storm is not capable of damaging the pier; (2) partial or complete removal of the pier from the water in advance of a storm; and (3) the installation of protection systems. The first option is inordinately expensive, and often aesthetically unacceptable. It is also sometimes environmentally unacceptable for large, bulky objects to be constructed in environmentally sensitive areas. The partial or complete removal of a pier from the water is also not completely acceptable in many instances. First, the removal of a pier and subsequent reinstallation of a pier into a body of water can be expensive and/or time consuming and could be a recurring unacceptable disturbance to environmentally sensitive areas. A third alternative for protecting piers from storm related damage is to install protective systems such as bumpers. However, in many instances these protective measures are inadequate to prevent storm-related damage.

U.S. Pat. No. 6,663,322 issued Dec. 16, 2003 to Listle discloses a pier system constructed of steel reinforced concrete piles with additional concrete footers and also includes embedding railing and deck support structures into the concrete piles. The pier system of Listle is fairly complex and does not easily lend itself to construction by those skilled in the art. In addition, the construction methods required to construct such a structure in a marine environment would require specialized construction skill and methods and would necessarily increase the cost far beyond what would normally be expected.

U.S. Pat. No. 6,128,880 issued Oct. 10, 2000 to Meenan, Jr. discloses a removable modular decking system that incorporates deck sections comprising decking planks that, by means of removable clamps, can be removed from the support structures of the pier. The decking planks are attached to rails that are located on the under side of the decking planks. When the clamps are disengaged the decking planks can then be rolled up and transported away from the pier. A major drawback, however, of the modular decking system of Meenan, Jr. is that the decking planks are inter-connected on the underside of the decking by means of the rail. This being the case, the decking sections would need to be removed from the pier and then turned up side down in order to facilitate rolling the sections up. A further disadvantage of the modular decking system of Meenan, Jr. is difficulty inherent in rolling up the modular decking sections if handrails are present on the dock. The presence of such handrails, if not constructed an adequate distance away from the decking sections, would prevent the decking sections from being rolled up. The construction of such a handrail would require detailed and difficult construction methods not normally employed in the construction of marine piers. In addition, another disadvantage of the modular decking system of Meenan, Jr. is that the rolling up, handling and transporting of decking sections would necessarily be difficult to accomplish and might easily require more effort and experience than most pier owners and users are capable of. In addition, the storage of so many large and bulky decking sections away from the pier may not be possible due to limited space. And, finally, unless the rolled up decking sections are either adequately anchored or otherwise protected, the storm surge typically associated with violent storm events near water may cause unwanted movement of the rolled up decking sections thereby causing unnecessary hazard to human health and wellbeing as well as potential damage to property.

In light of the foregoing problems, it is a principal object of the present invention to provide a pier system which is substantially immune to storm related damage and can be used year after year without the need to re-build the pier after each significant storm event.

It is a further object of the present invention to provide an economical pier system which is substantially immune to storm damage by allowing a plurality of decking sections to be automatically deployed, or disengaged, from the pile supports during storm events, and can be easily and quickly reassembled when the storm is gone.

It is a still further object of the present invention to provide a pier system that is easy to manufacture, install, operate and reassemble.

It is a still further object of the present invention to provide a pier system which employs tethers between decking sections and pile bents to prevent decking sections from being transported away from the pier during storm events.

It is a still further object of the present invention to provide a pier system that employs damage control systems to prevent damage to pile bents and decking sections while the decking sections are in the water.

It is a still further object of the present invention to provide a pier system which is made up of many substantially identical or modular parts, for economy of manufacture, and which can be constructed of different dimensions and materials for various locations and application of uses.

It is a still further object of the present invention to provide a pier system that will minimize damage to property by preventing or minimizing debris associated with destructive storm forces.

It is a still further object of the present invention to provide a pier system that will minimize hazard to human life during storm events by preventing or minimizing debris associated with destructive storm forces.

It is a still further object of the present invention to provide a pier system that will minimize insurance rates for insuring such pier systems by preventing or minimizing the need to re-construct piers after storm events.

SUMMARY OF THE INVENTION

Briefly described, a pier system in accordance with the invention comprises a plurality of decking sections mounted upon a plurality of pile bent sections and removably attached thereto by a plurality of selectively detachable attachment mechanisms. The system incorporates construction methods normally utilized for building marine piers. When in normal use mode, the pier system is equivalent in appearance and function to prior art conventional piers. When desired, as ahead of violent storm events, the decking sections may be intentionally unlatched from the pile bent sections by opening the attachment mechanisms and allowed to separate from the pile bent sections and float by way of wave, wind or tidal action. While in such deployed mode, the decking sections remain tethered to and near to the pile bent sections, and after the storm event has passed the deck sections may be easily placed back upon the pile bent sections and reattached using the original attachment mechanisms so that the pier is again in its normal use mode.

The selectively removable attachment mechanisms are for keeping the decking sections rigidly supported above the waterline by the pile bent sections when the system is in the normal use mode so that no movement of the decking sections, vertically or horizontally, is allowed. The attachment mechanisms, when unlocked, allow the deck sections to move relative to the pile bent sections so that the decking sections are free to move when influenced by tidal, wave or wind action, yet remain connected to the pile bent sections by a plurality of tethers. The tether means preferably include mechanisms or apparatus to connect one end of a tether to one decking section and the other end of the tether to a pile bent section or other anchor mechanism.

A currently-preferred method for making a pier system in accordance with the invention uses a plurality of substantially identical components. For example, ten or more substantially identical pile support systems and ten or more substantially identical decking sections are utilized. Each horizontal decking section is installed onto a pair of adjacent pile supports until the required length of structure is obtained. A plurality of substantially identical attachment mechanisms is then attached to the pile supports and decking sections as described above to secure the decking sections to the pile supports.

In some applications, it may be desirable to include one or more joists extending longitudinally of the pier to connect adjacent pile supports and being disposed between the pile supports and the decking sections.

The specifics of my preferred method of making the pier system are described in detail below. These and other aspects, features, and objects and advantages of the present invention will become apparent to those skilled in the art upon studying the detailed description presented below along with the accompanying drawings and claims.

BRIEF DESCRIPTION OF THE DRAWINGS

The drawings form an integral part of the description of the preferred embodiments and are to be read in conjunction therewith. Like reference numerals designate the same or similar components or features in the various drawings, wherein.

DETAILED DESCRIPTION OF THE INVENTION

Figure 1:
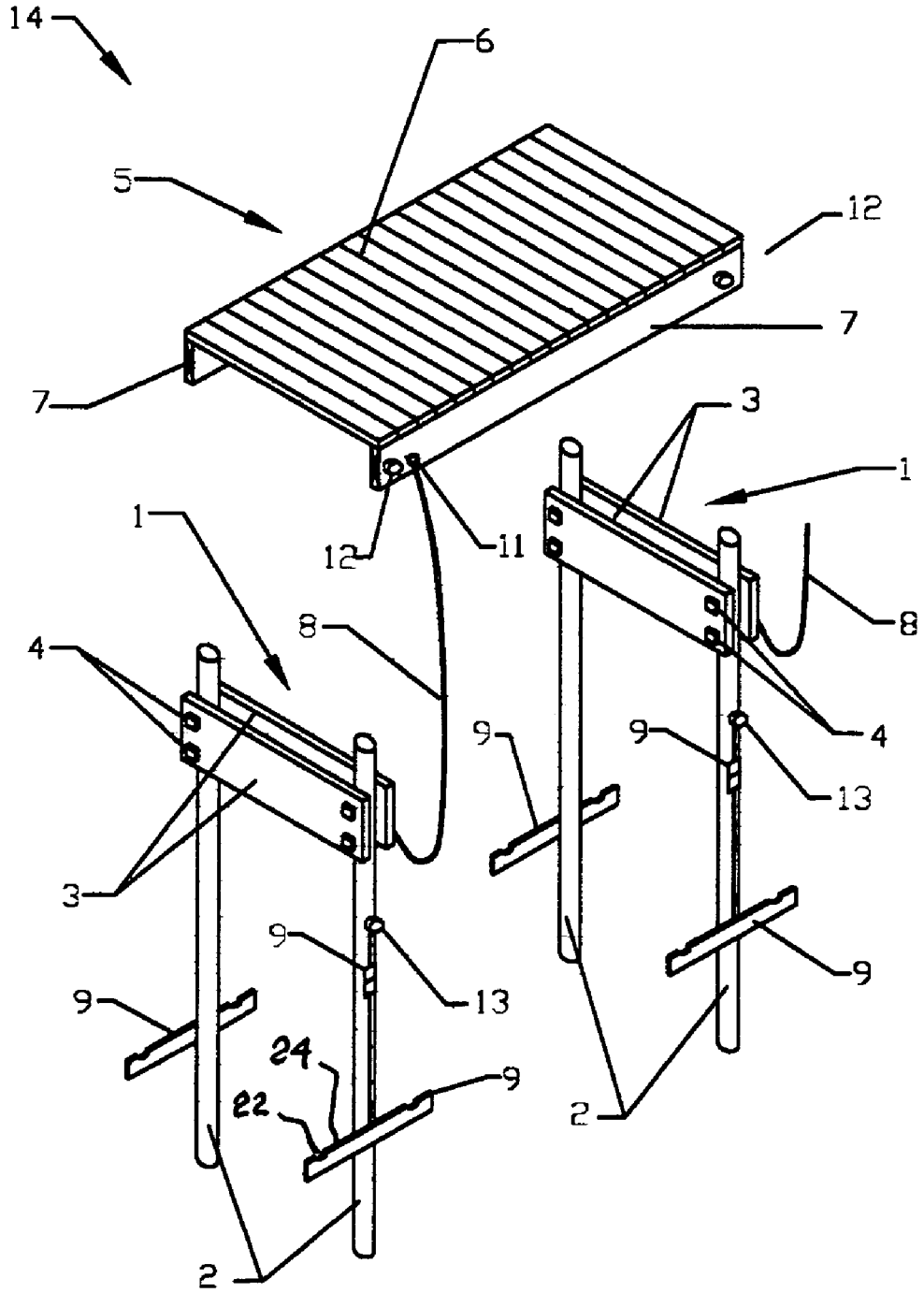
FIG. 1 is a perspective view of two pile bents and one deck section of the new and improved pier system in deployed mode.
Figure 2:
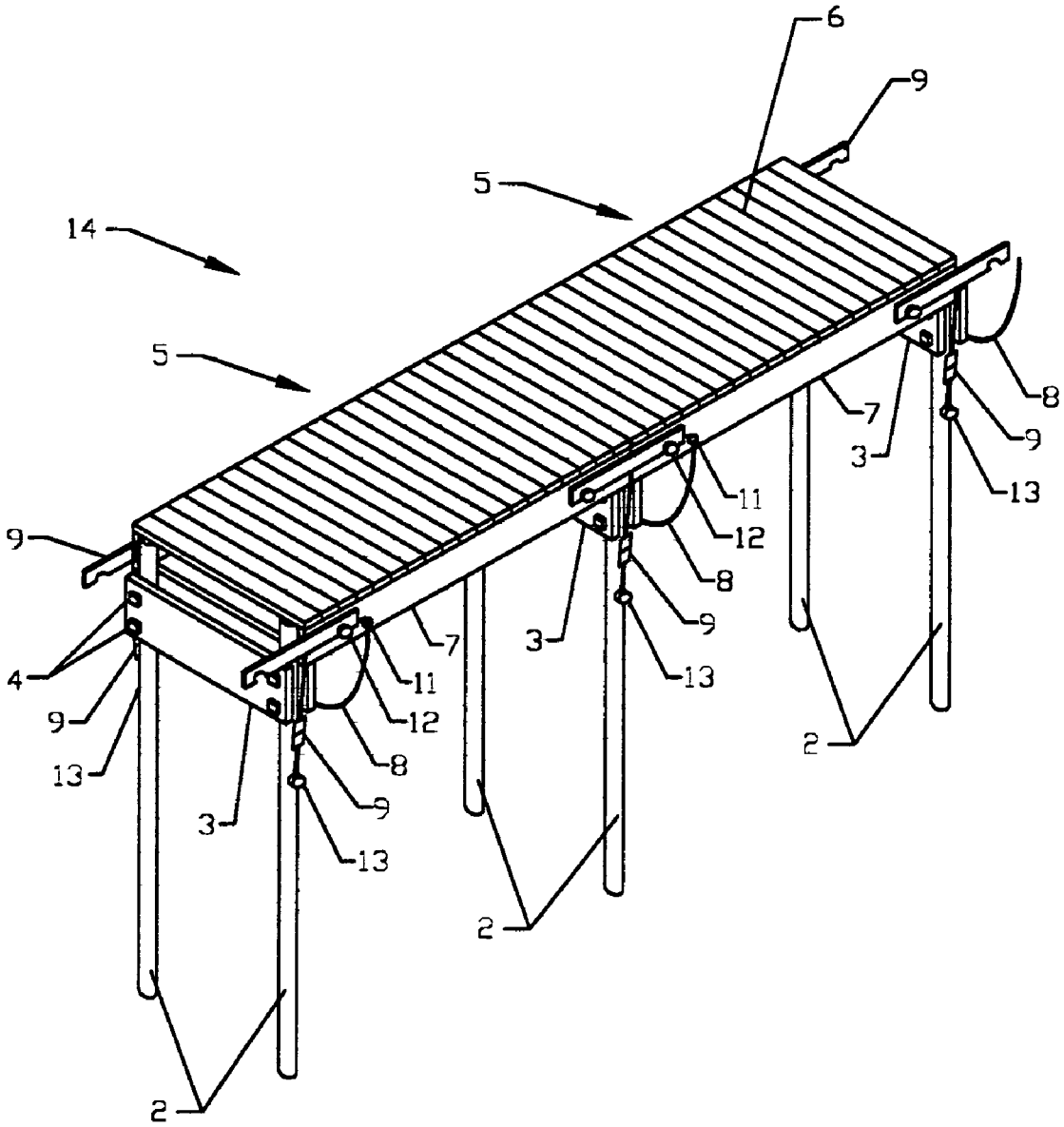
FIG. 2 is a perspective view of three pile bents and two deck sections of the new and improved pier system in normal use mode.

With reference now to the drawings, and in particular to FIGS. 1 through 5, there is shown a currently-preferred embodiment 14 of a new and improved tethered sectional pier system in accordance with the invention.

Pier system 14 comprises a plurality of components that in their broadest context include a plurality of pile bents 1, a plurality of deck sections 5, a plurality of tethers 8, and a plurality of attachment mechanisms 9. As described below, such components are individually configured and correlated with respect to each other so as to attain the desired objective.

First provided are a plurality of pile bents 1 which preferably are fabricated on-site from suitable materials, for example, steel pipe or treated wooden piling. Pilings 2 are installed into the lake or ocean bottom 20 as by driving, jetting, or other means. One or more, preferably two, horizontal support cross members 3 are then attached to and near the top of the pilings 2. The horizontal support members 3 are attached to the pilings 2 by bolts, lag screws or other means 4. The tops of the pilings are cut off at a height that will allow the decking section stringers 7 to rest on the top of the horizontal support members 3.

Figure 3:
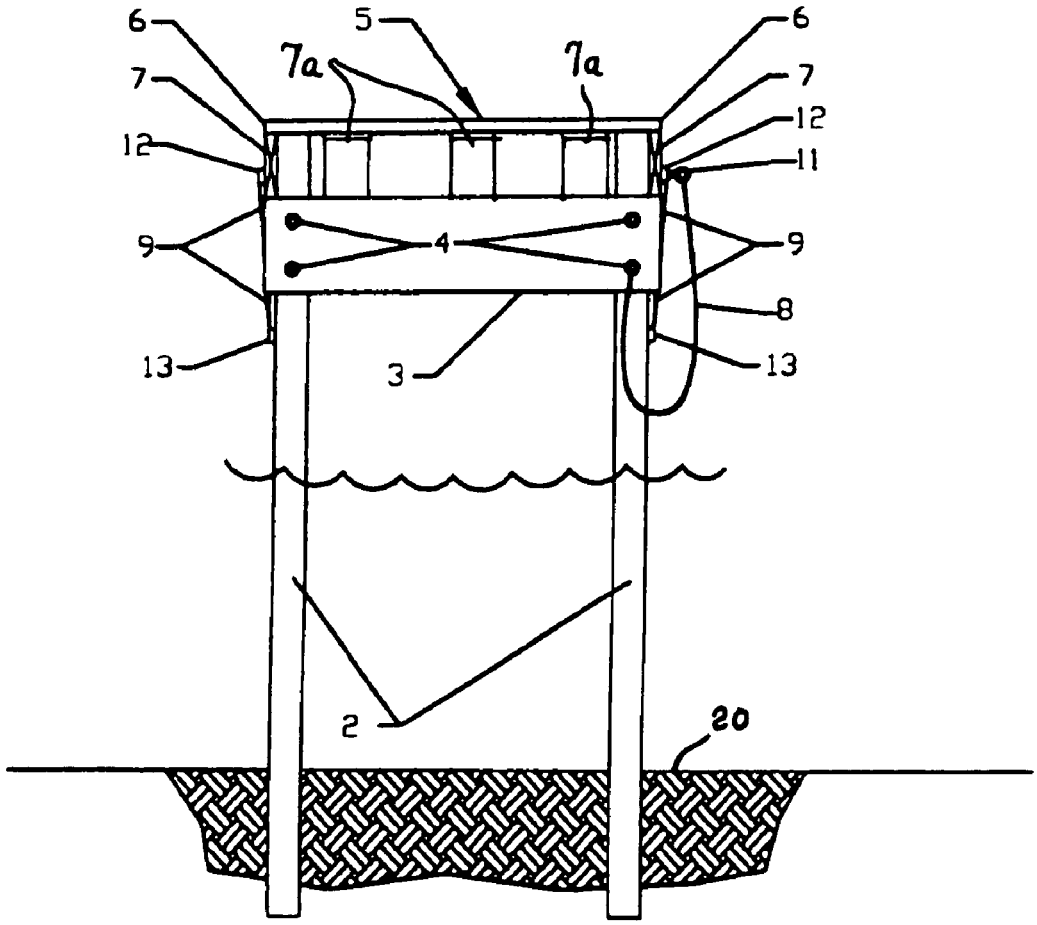
FIG. 3 is a front elevational view of a pile bent and deck section in normal use mode.
Figure 4:
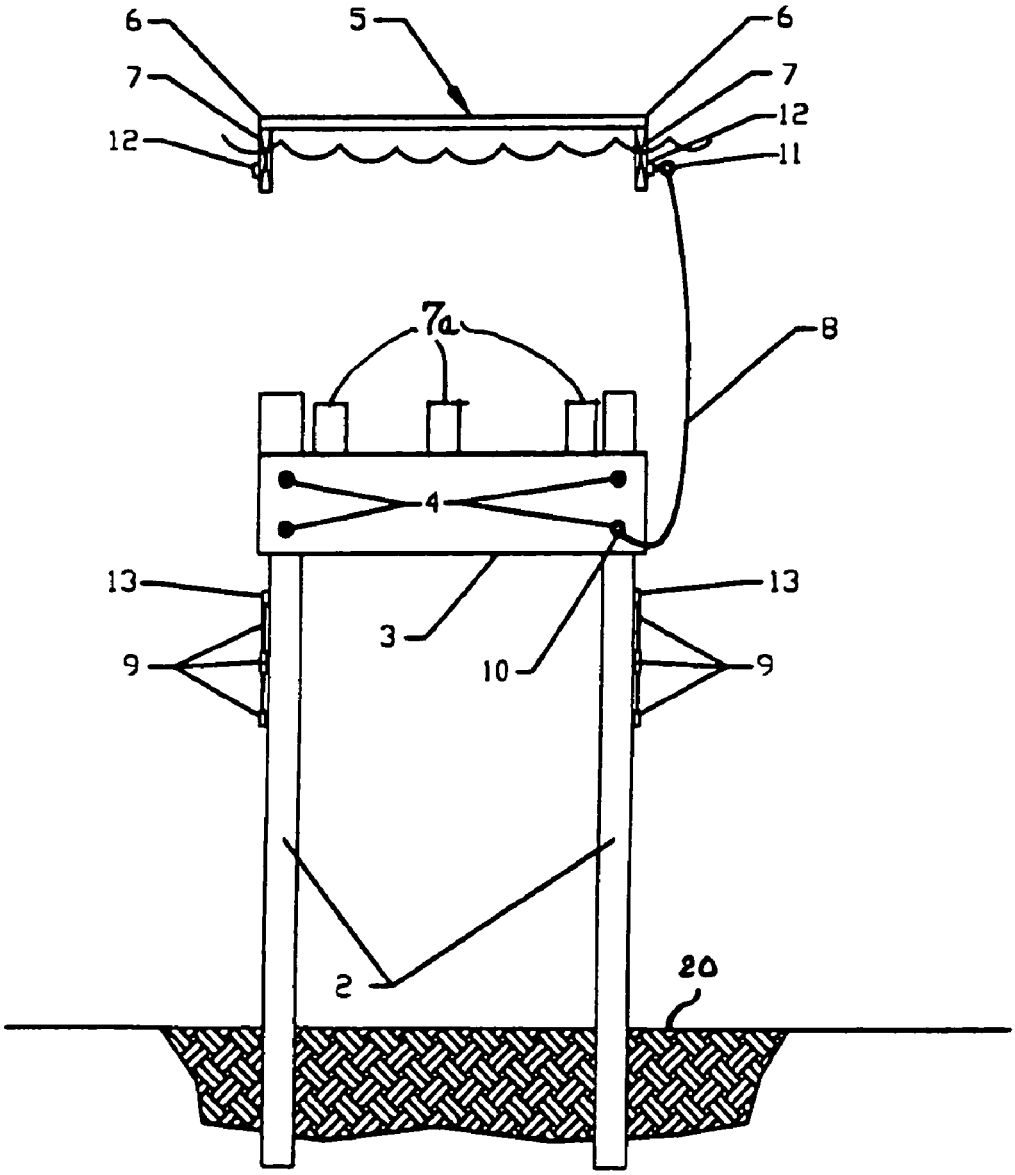
FIG. 4 is a front elevational view of a pile bent and deck section in deployed mode.
Figure 5:
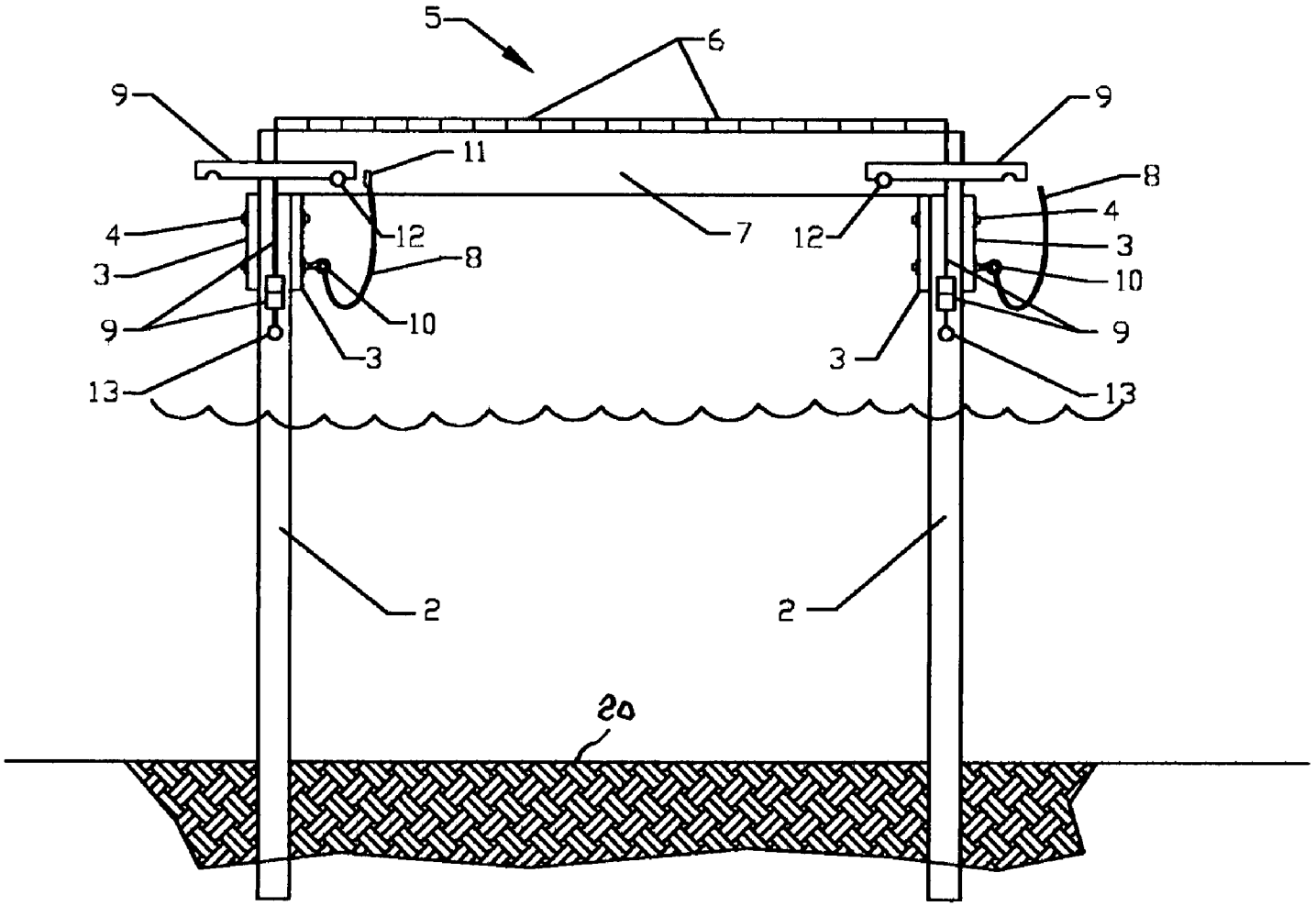
FIG. 5 is a side elevational view of two pile bents and a deck section in normal use mode.

Referring to FIGS. 3 and 4, in some applications it may be desirable to include one or more joists 7*a* extending longitudinally of the pier to connect adjacent pile supports and being disposed between the pile supports and the decking sections. Joists 7*a* are connected conventionally to horizontal support members 3.

Next provided is a plurality of decking sections 5 which may be fabricated on- or off-site and comprise two or more horizontal stringers 7 and a plurality of transverse planks 6. The planks 6 are attached to the tops of the horizontal stringers 7 by nails, screws, or other means of attachment.

Next provided is a plurality of attachment mechanisms 9 that may be fabricated of metal, plastic, cable, wire, rubber webbing, binders or any other materials suitable to function as a means to rigidly but removably attach the deck sections 5 to the pile bents 1 and further function in normal use mode to prevent the deck sections 5 from being removed from the pile bents 1 by wave action, wind action, or tidal action. The attachment mechanism also prevents movement of the deck sections in any direction. The attachment mechanisms 9 are fabricated and installed in such a way as to allow the user of the tethered sectional pier system 14 to easily and quickly detach or unlock the deck sections 5 from the pile bents 1 in the event of an approaching storm. The attachment mechanisms preferably are fabricated off-site and are attached to the pilings 2 by means of an attachment anchor 13. Such attachment anchors 13 are fabricated of metal, plastic or other materials. After attaching the attachment anchor 13 to the pilings 2 the opposite end of the attachment mechanism 9 is attached to the ends of two (2) adjacent deck sections 5 by means of additional attachment anchors 12.

Figure 6:
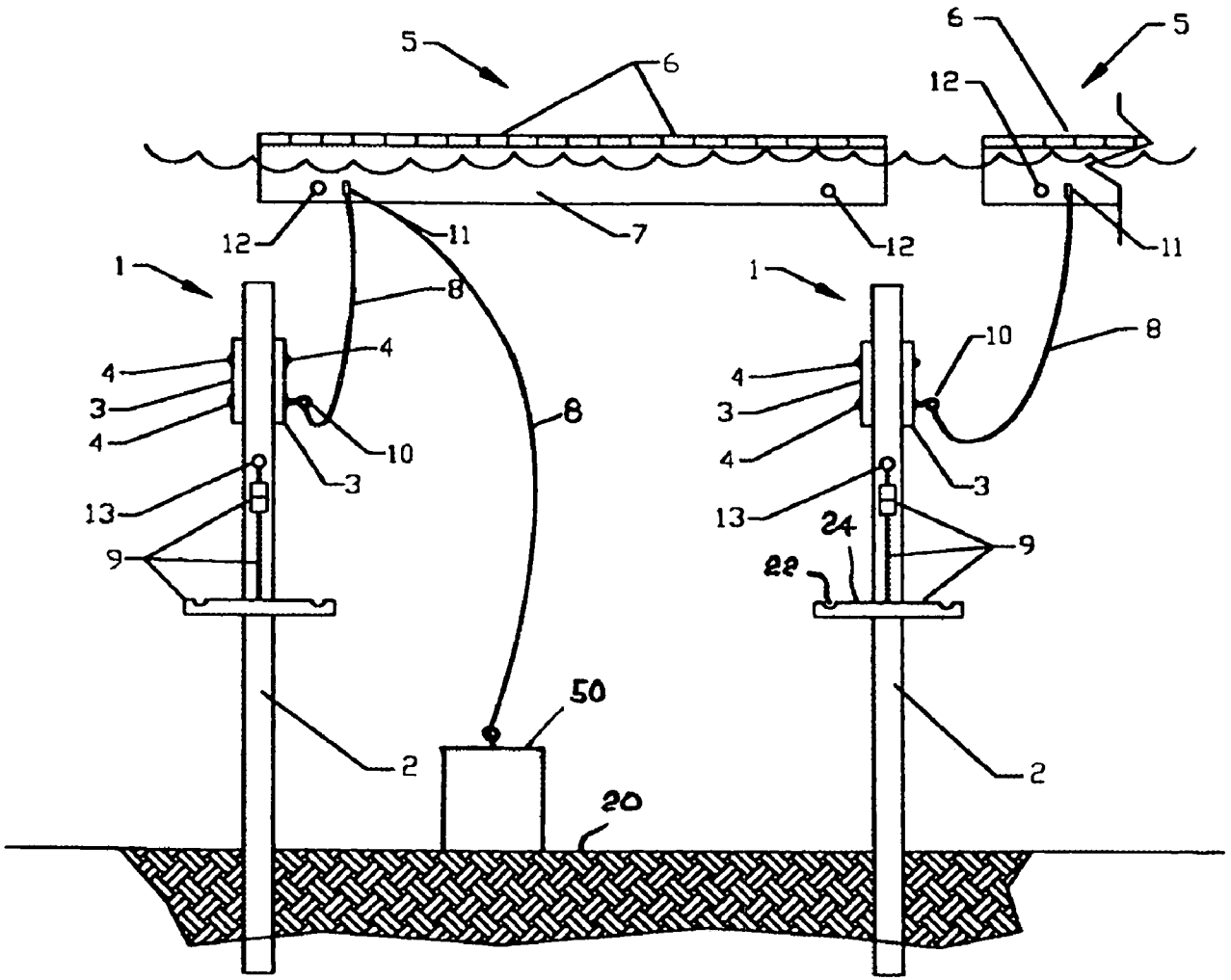
FIG. 6 is a side elevational view of two pile bents and a deck section in deployed mode.
Figure 7:
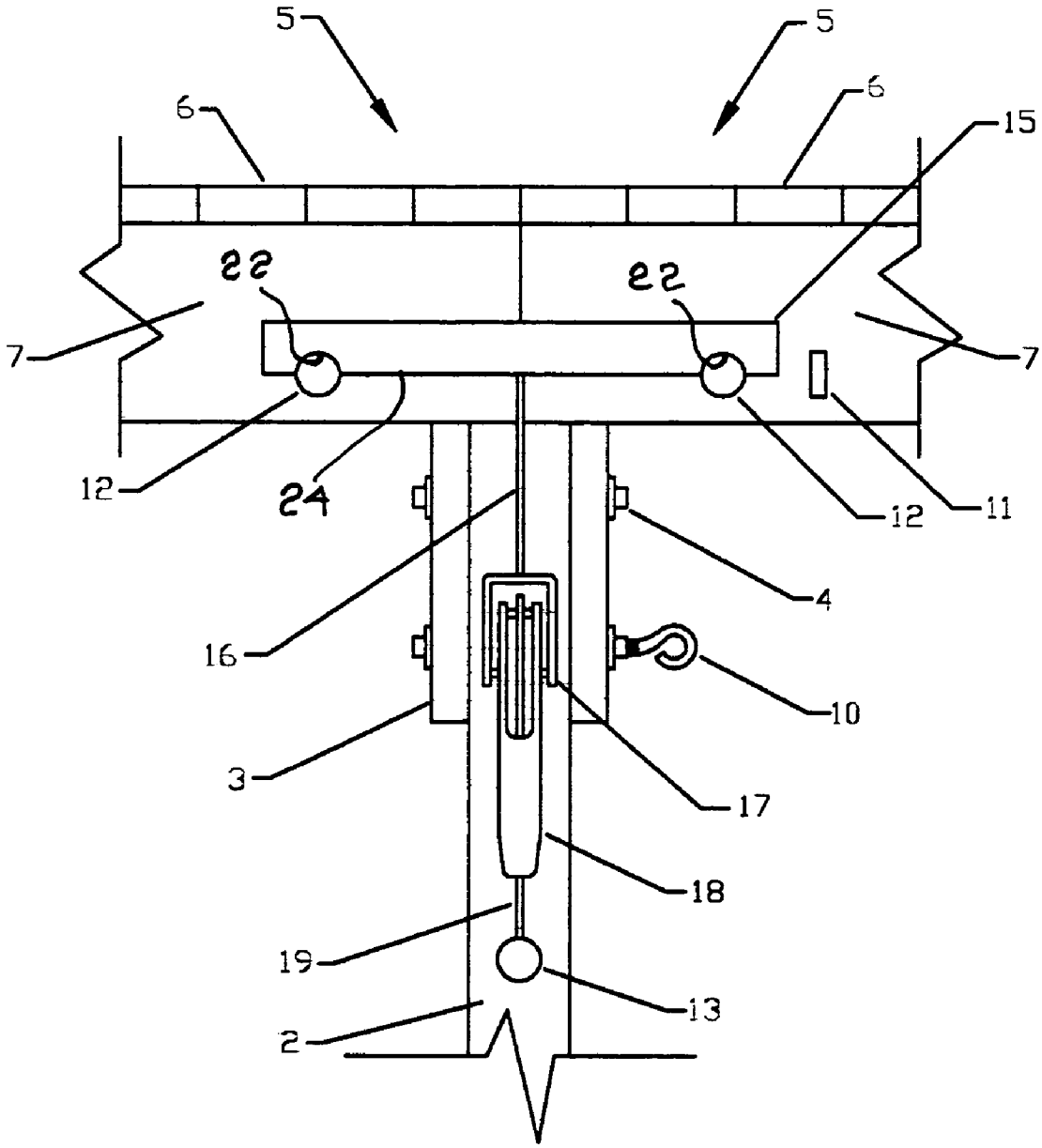
FIG. 7 is a detailed elevational front view of a currently-preferred embodiment of a selectively removable attachment mechanism in normal use mode.

Next provided is a plurality of tethers 8 which preferably are fabricated off-site of cable, webbing, cord, rope or similar strong, flexible, durable material and can also include shock damping devices. The tethers 8 function to prevent the decking sections 5 from being carried away from the pile bents 1 by wave action, wind action or tidal action when system 14 is in deployed mode. Preferably, one end of each tether 8 is connected to a pile bent 1 by means of an attachment anchor 10. Such anchor is fabricated of metal pins, eyebolts or other means installed on any part of the pile bent 1 such as a piling 2 or horizontal support member 3. This end of the tether may also be connected to a seabottom-anchor device 50 (FIG. 6) that is separate from the pile bent. Such anchor device may be a conventional fluked anchor or it can be fabricated on or off-site of concrete, pilings, pipes or any configuration of materials that will provide sufficient anchorage into sea bottom 20 to achieve the objectives of the present invention. The opposite end of each tether 8 is connected to the end of a decking section 5 by means of an additional attachment anchor 11.

With reference now to FIGS. 6 through 12, a currently-preferred exemplary embodiment of a selectively detachable attachment mechanism generally designated by the reference numeral 9 is described. Other selectively detachable attachment means, of course, are fully comprehended by the invention.

Attachment mechanism 9 comprises a metal hold down bar 15 having two or more circular cut-outs 22 formed in bottom edge 24 to allow for positive and secure placement on the adjacent decking sections attachment points 12. Attached to the metal hold down bar 15 is a top attachment cable 16. The top attachment cable 16 can be fabricated of metal, plastic, rubber or other suitable materials capable of providing sufficient tensile strength to achieve the objectives of the present invention. The opposite end of the top attachment cable 16 is attached to the body of a lever binder 17. The lever binder can be fabricated of metal, plastic, composites or any combination thereof, to achieve the objectives of the present invention. The lever binder 17 incorporates a handle 18 and is connected to a bottom attachment cable 19 similar to top attachment cable 16. The bottom cable 19 is attached to an attachment anchor 13 installed on the pile. The pile attachment anchor 13 can be fabricated of metal, plastic or other materials.

Figure 8:
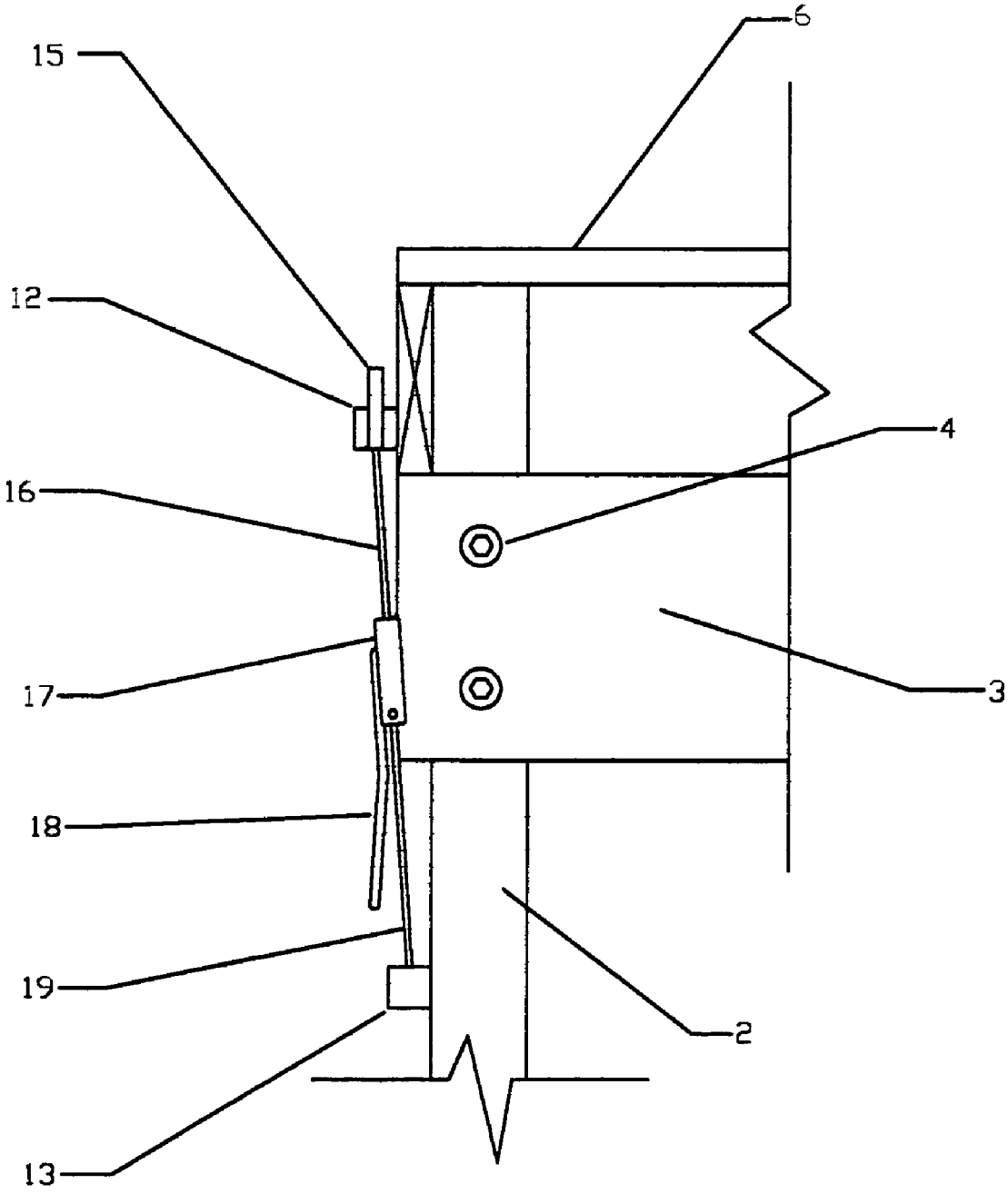
FIG. 8 is a detailed side elevational view of the attachment mechanism shown in FIG. 7.
Figure 9:
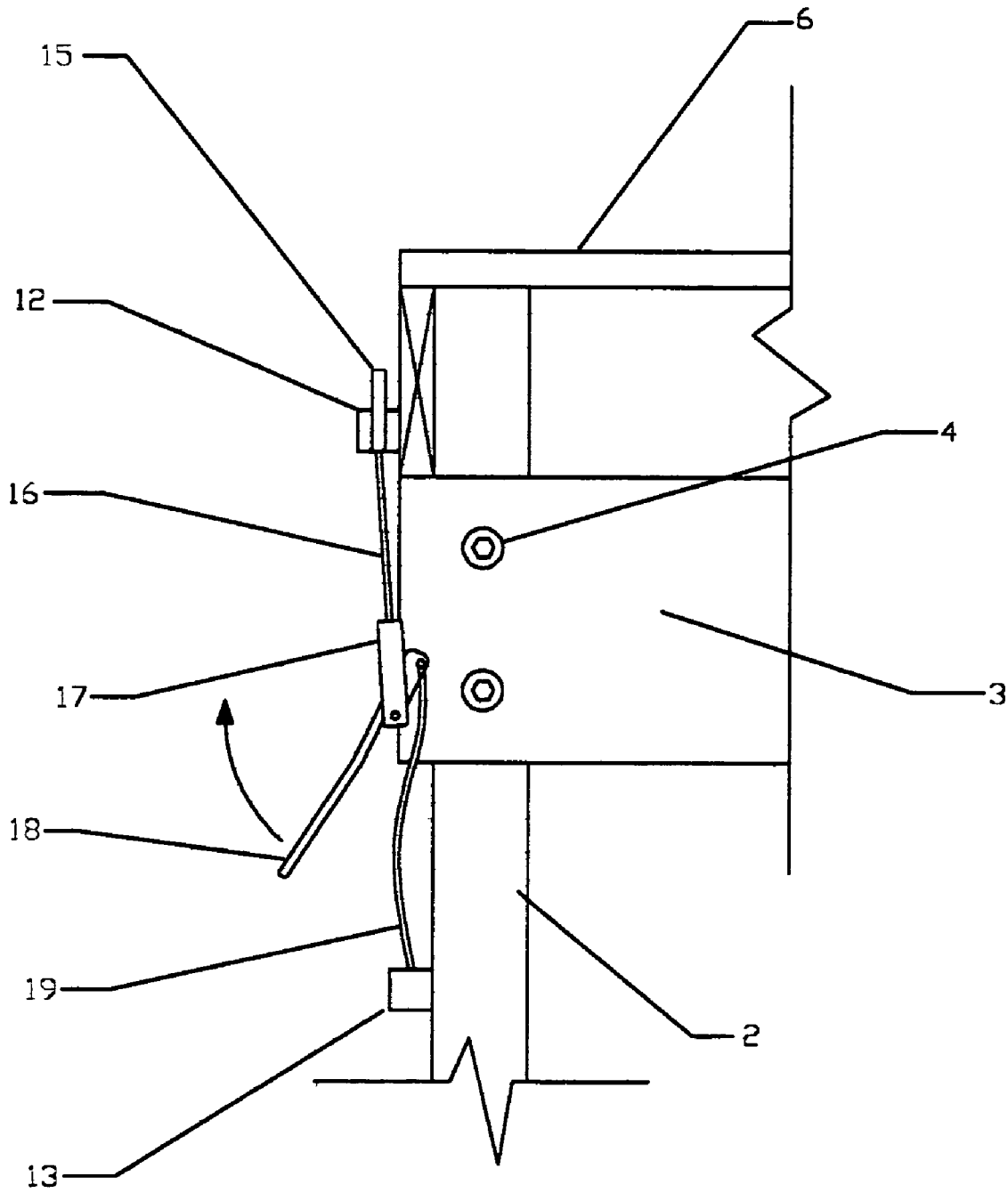
FIGS. 9 through 12 are detailed side elevational views of the attachment mechanism shown in FIGS. 7 and 8, showing a progression of attachment stages between fully engaged (FIG. 8) and fully disengaged, or deployed, (FIG. 12).
Figure 10:
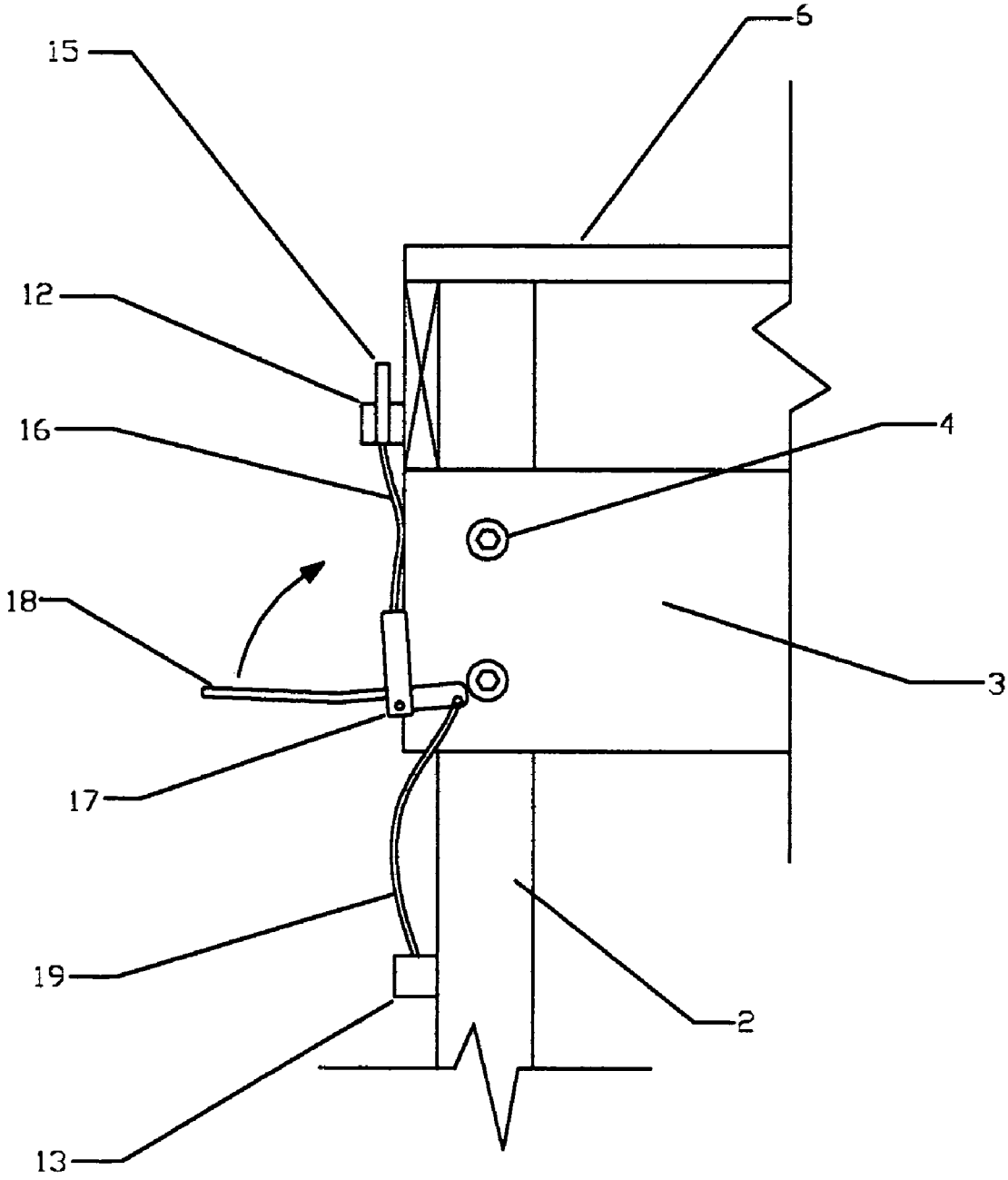
Figure 11:
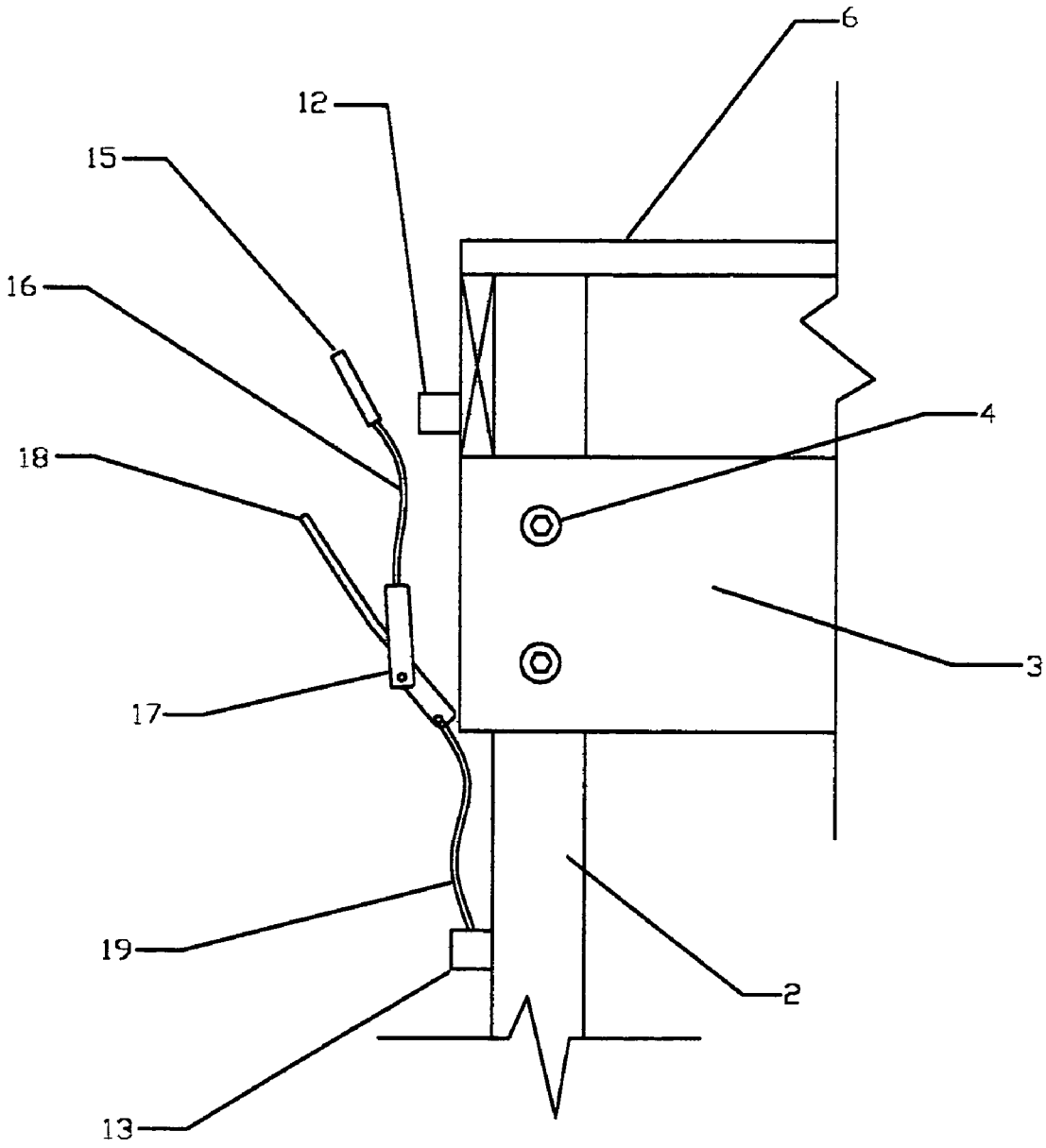

Once the decking sections 5 have been placed onto the pile bents 1, the attachment mechanisms 9 are installed and locked in normal use mode, as shown in FIG. 8. While in this mode, the attachment mechanism 9 holds the decking sections rigidly in place by applying tension to the top attachment cable 16 and the bottom attachment cable 19 via a conventional over-center locking mechanism, thereby preventing vertical and horizontal movement of the decking sections.

Figure 12:
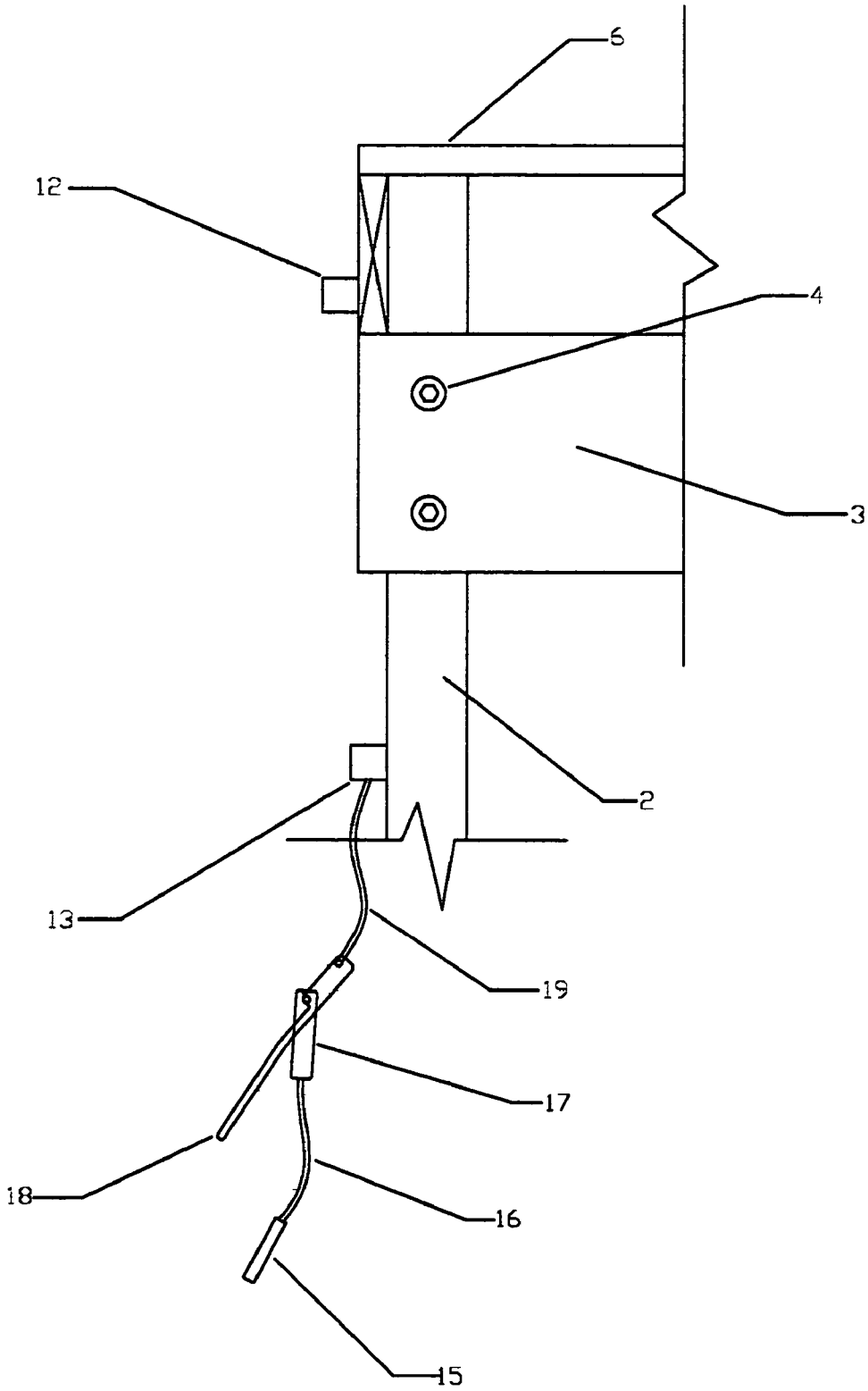

Referring now to FIGS. 8 through 12, upon the approach of a violent storm event each attachment mechanism 9 may be placed by an operator into deployed mode by rotating the lever binder lever 18. When the lever binder lever 18 is rotated upward, tension is released on the bottom attachment cable 19 and top attachment cable 16. Once the lever binder lever is fully rotated enough slack is created in the bottom attachment mechanism 19 and top attachment mechanism 16 to allow the metal hold down bar 15 to be completely removed from decking section attachment points 12. Once the metal hold down bar 15 is removed from the decking section attachment points 12 the entire attachment mechanism 9 is then allowed to hang free while remaining connected to the pile 2 by attachment anchor 13, as shown in FIGS. 1, 4, and 12. When the attachment mechanism 9 is hanging free of decking section 5, the Tethered Sectional Pier 14 is deemed to be in a deployed mode. While in deployed mode, the decking sections 5 are free to move horizontally and vertically by means of wave, tidal or wind action while remaining contrained from loss by tethers 8.

During a sufficiently violent storm event, the decking sections 5 will be lifted from the pile bents 1 by wave, tidal or wind forces, but decking sections 5 will remain tethered to the pile bents 1 by mean of tethers 8 described above. Once the storm event has passed, the decking sections 5 may be retrieved and placed back onto their respective pile bents 1 and the attachment mechanisms 9 returned to the normal use mode by placing the metal hold down bar 15 onto the adjacent decking sections attachment points 12 as in original assembly. The lever binder lever 18 is then rotated to its closed position to once again place the bottom attachment cable 19 and the top attachment cable 16 in tension. Once the attachment mechanism 9 is placed in the rigid or normal state and, therefore, tension is applied to the bottom attachment cable 19 and top attachment cable 16 the Tethered Sectional Pier 14 is said to be in the normal use mode.

With respect to the above descriptions then, it should be realized that the optimum dimensional relationships for the parts of the invention, to include variations in size, materials, shape, form, function, and manner of operation, assembly, and use, will be readily apparent and obvious to one skilled in the art, and all equivalent relationships to those illustrated in the drawings and described in the specification are encompassed by the present invention. Therefore, the foregoing should be considered as illustrative only of the principle of the invention.

Further, since numerous modifications and changes will readily occur to those skilled in the art, it is not desired to limit the invention to the exact construction and operation shown and described, and accordingly, all modifications and equivalents as may be resorted to are to be considered as falling within the scope of the invention.

What is claimed is:

1. A pier system, comprising:

a) a plurality of pile bents, each of said pile bents including a horizontal member;

b) at least one decking section disposed on top of, and non-floatingly supported by, said horizontal members;

c) at least one selectively detachable attachment mechanisms for removably attaching said decking section to said pile bents; and d) at least one tether connected between an anchor means and said one decking section, wherein said selectively detachable attachment mechanism when attached between said decking section and one of said pile bents places said pier system in a normal use mode, wherein said selectively detachable attachment mechanism when detached from said decking section places said pier system in a deployed mode, and wherein said decking section is firmly attached to said pile bents when said system in is said normal use mode, and wherein said decking section is not attached to said pile bents when said system is in deployed mode.

2. A pier system in accordance with claim 1 wherein said decking section remains connected to said anchor means by said tether when said system is in deployed mode.

3. A pier system in accordance with claim 1 wherein said system may be changed from said deployed mode to said normal use mode by:

a) reinstalling said decking section onto said pile bents;

b) reconnecting said selectively detachable attachment mechanism to said decking section; and c) locking said attachment mechanism into normal use mode.

4. A pier system, comprising:

a) a plurality of pile bents, each of said pile bents including a horizontal member;

b) at least one decking section disposed on top of, and non-floatingly supported by, said horizontal members;

c) at least one selectively detachable attachment mechanism for removably attaching said decking section to said pile bents;

d) at least one tether connected between an anchor means and said one decking section;

e) a plurality of said decking sections disposed on said plurality of pile bents;

f) a plurality of said selectively detachable attachment mechanisms for removably attaching said plurality of decking sections to said plurality of pile bents;

g) a plurality of said tethers connected between said plurality of decking sections and at least one anchor means; and h) a plurality of joists extending between and attached to said plurality of pile bents.

* * * * *